United States Patent [19]

Casilli

[11] Patent Number: 4,555,222

[45] Date of Patent: Nov. 26, 1985

[54] AIR-OPERATED DIAPHRAGM PUMP AND A VALVE ARRANGEMENT THEREFOR

[75] Inventor: Joseph C. Casilli, Waldwick, N.J.

[73] Assignee: International Telephone and Telegraph Corporation, New York, N.Y.

[21] Appl. No.: 564,947

[22] Filed: Dec. 23, 1983

[51] Int. Cl.[4] ..... F04B 43/06

[52] U.S. Cl. ..... 417/393; 91/313

[58] Field of Search ..... 417/393; 91/305, 306, 91/313; 137/625.6; 251/368

[56] References Cited

U.S. PATENT DOCUMENTS

| | | | |
|---|---|---|---|
| 3,514,237 | 5/1970 | Spyridakis | 417/DIG. 1 |
| 3,618,468 | 11/1971 | Gardner et al. | 91/306 X |
| 3,747,479 | 7/1973 | Nightingale et al. | 251/368 X |
| 3,770,009 | 11/1973 | Miller | 251/368 X |
| 4,381,180 | 4/1983 | Sell | 417/393 |
| 4,450,869 | 5/1984 | Acker | 137/625.66 |

FOREIGN PATENT DOCUMENTS

| | | | |
|---|---|---|---|
| 663537 | 5/1963 | Canada | 417/397 |
| 2606475 | 9/1976 | Fed. Rep. of Germany | 137/625.66 |

*Primary Examiner*—Leonard E. Smith

*Attorney, Agent, or Firm*—John T. O'Halloran; Peter R. Ruzek

[57] ABSTRACT

A diaphragm pump pumping arrangement includes two diaphragm pumps which are arranged and operate in tandem. Each of the diaphragm pumps includes a housing and a movable wall that includes a flexible diaphragm and subdivides the interior of the respective pump housing into a pumping chamber and an actuating chamber. An air distributing control arrangement interposed between and connected to the pump housings includes a spool valve movable in a bore of an aluminum casing of the control arrangement between two end positions in which it alternatingly achieves the admission of the compressed air into one, and discharge of the air from the other, actuating chamber. The spool valve is displaced due to the action of respective limiting valves accommodated in individual bores of the control arrangement and displaced by the respective movable walls from their rest positions in which they admit the ambient pressure to the associated end faces to their active positions in which they admit the compressed air to the associated end faces of the spool valve. The spool valve carries sealing rings of a material that needs no lubrication, and is made, at least at its peripheral surface, of a material that also needs no lubrication, and the surface bounding the bore for the spool valve is hard-anodized, so that no external lubrication of the control arrangement, by lubricant entrained in the compressed air or otherwise, is needed.

12 Claims, 3 Drawing Figures

AIR-OPERATED DIAPHRAGM PUMP AND A VALVE ARRANGEMENT THEREFOR

BACKGROUND OF THE INVENTION

The present invention relates to pumps in general and, more particularly, to air-operated diaphragm pumps and to valve arrangements therefor.

There are already known various constructions of pumps, among them such which are particularly suited for pumping liquids with high viscosity, such as paint or the like. Some of the known pumps are constructed as diaphragm pumps in which compressed air or similar gaseous medium is being used for achieving the pumping action. In pumps of this type, a movable wall including a flexible diaphragm extends across the internal space of the pump casing to sealingly subdivide such interior into a pumping chamber for the liquid to be pumped and an actuating chamber into which the pressurized gaseous medium is admitted to exert its pressure on the movable wall and from which it is discharged, thus to achieve the pumping action. Such diaphragm pumps are often used in tandem, that is, two of such pumps are being used at the same time, these pumps having their movable walls connected for movement in unison so that, while one of the diaphragm pumps has the pressurized gaseous fluid admitted into its actuating chamber and thus pumps the liquid, the contents of the actuating chamber of the other pump is discharged as the movable wall moves in unison with the first-mentioned pump movable wall and, hence, additional liquid is being drawn into the pumping chamber of the latter pump.

It will be appreciated that, to achieve the above-described pumping action in the pump arrangement including the two tandem pumps, it is necessary to provide for control of the admission and discharge of the gaseous fluid or medium to and from the actuating chambers of the two pumps in an organized and precisely timed manner. To this end, there have already been developed various constructions of control and/or distributing valve assemblies. However, experience with the control assemblies or arrangements of this type which have become known so far has shown that they suffer from many drawbacks. One of the disadvantages of the control or distributing arrangements of conventional constructions is that, more often than not, they need to be lubricated, which is frequently done by entraining droplets of oil in the pressurized gaseous medium. It will be appreciated that, if the pressurized gaseous medium contains any contaminants, such as particles of dust or the like, such contaminants will be captured by the lubricant and thus perform an abrading function in the valve arrangement, which will result in excessive wear of the various components of the latter.

SUMMARY OF THE INVENTION

Accordingly, it is a general object of the present invention to avoid the disadvantages of the prior art.

More particularly, it is an object of the present invention to provide a pumping arrangement and a distributing or control arrangement therefor, which do not possess the disadvantages of the conventional arrangements of the same or similar type.

Still another object of the present invention is so to construct the pumping arrangement of the type here under consideration that the timing of the distribution of the gaseous medium is controlled in dependency on the extent of movement of the movable walls of the tandem diaphragm pumps.

It is yet another object of the present invention to provide a valve arrangement, particularly for use in the pumping arrangement of the above type, which does not need any lubrication.

A concomitant object of the present invention is so to design the valve arrangement as to be simple in construction, inexpensive to manufacture, easy to use, and reliable in operation nevertheless.

In pursuance of these objects and others which will become apparent hereafter, one feature of the present invention resides in a pumping arrangement of the above type, with two diaphragm pumps arranged and operating in tandem, wherein two limiting valve assemblies are accommodated in respective bores of the housing of the control valve arrangement and have stem portions that extend into the respective actuating chambers and into the paths of movement of the respective movable walls. These control valve assemblies control the admission of pressurized gaseous medium to, and its discharge from, the spaces adjacent to the axial ends of a distributing valve which controls the admission and discharge of pressurized gaseous medium to and from the actuating chambers. In one end position of the limiting valve assembly, into which it is urged by a spring, the limiting valve assembly connects the respective space with the discharge conduit and thus with the ambient atmosphere. In the other end position, the limiting valve assembly connects the space with the supply of the pressurized gaseous medium. The distributing valve body, which is configurated as a spool, is thus shifted between its terminal positions to alternatingly admit the pressurized medium into and discharge the same from the actuating chambers.

According to another aspect of the present invention, the housing of the control arrangement is made of aluminum, and the surface bounding the bore receiving the spool has a hard anodized coating thereon. At least that portion of spool which comes in contact with the hard anodized coating is made of a self-lubricating material. The spool carries, in respective grooves thereof, respective separating rings which are also made of a material that is self-lubricating. Experience and extensive testing of various combinations of materials have shown that it is particularly advantageous to make at least the aforementioned portion of the spool of polytetrafluoroethylene with a mica filler, and the separating rings of polytetrafluoroethylene filled with graphite. This particular combination of materials achieves excellent results, that is, the wear is kept to a minimum, the danger of seizing is non-existent, and the movability of the spool in its bore is unimpaired under all operating conditions.

DETAILED DESCRIPTION OF THE PREFERRED EMBODIMENT

Figure 1:
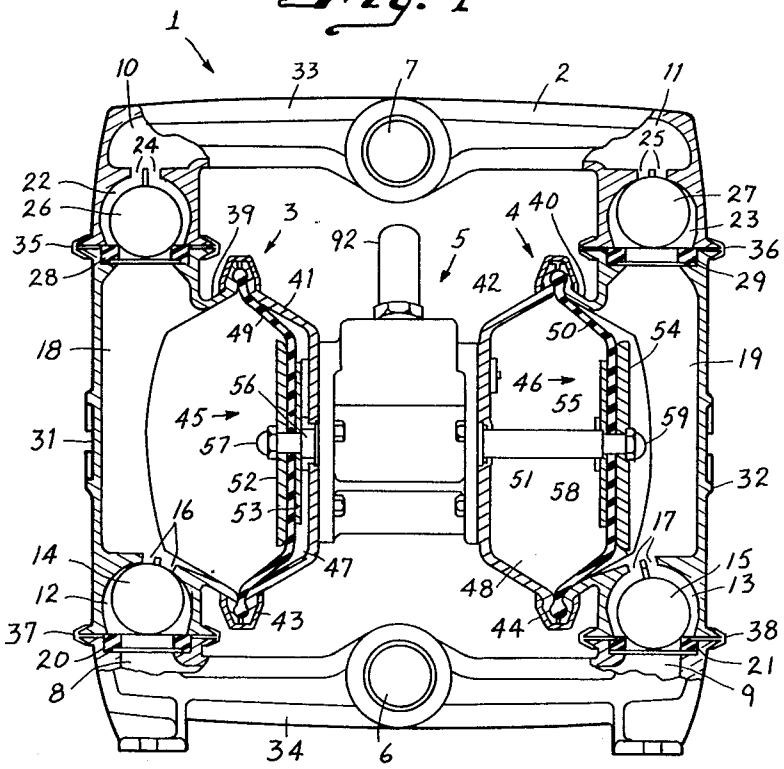
FIG. 1 is a side elevational view of the pumping arrangement embodying the present invention, in cross-section except for its control arrangement.

Referring now to the drawing in detail, and first to FIG. 1 thereof, it may be seen that the reference numeral 1 has been used to identify a pump constructed in accordance with the present invention in its entirety. The pump 1 includes, as its main components, a support or frame 2, two pumping arrangements 3 and 4, and an actuating and control arrangement 5 interposed between the two pumping arrangements 3 and 4 and controlling the operation thereof in a manner which will be discussed in greater detail later.

The support or frame 2 is hollow to bound a plurality of passages or compartments yet to be described. At its lower portion as considered in the drawing, the frame 2 is provided with a suction or inlet port 6 for the fluid to be pumped, while a discharge or outlet port 7 for the fluid being pumped is arranged at the upper portion of the frame 2. The inlet port 6 communicates with two inlet passages 8 and 9, and the outlet port 7 communicates with two outlet passages 10 and 11. The inlet passages 8 and 9 open into respective inlet valve compartments 12 and 13 that accommodate respective inlet valve balls 14 and 15 and communicate, via respective apertures 16 and 17, with respective pumping chambers 18 and 19. Furthermore, annular sealing elements 20 and 21 of elastic material are stationarily arranged at the lower portions of the respective compartments 12 and 13 to serve as valve seats for the respective valve balls 14 and 15.

The pumping chambers 18 and 19 respectively communicate, at their upper ends, with outlet valve compartments 22 and 23 which, in turn, communicate with the respective outlet passages 10 and 11 via apertures 24 and 25. The outlet valve compartments 22 and 23 accommodate respective outlet valve balls 26 and 27 as well as, at their lower parts, respective annular sealing elements 28 and 29 constituting valve seats for the respective outlet valve balls 26 and 27.

The frame 2 is shown to be constituted by separate lateral parts 31 and 32, and upper and lower transverse parts 33 and 34 which extend between and interconnect the lateral parts 31 and 32. The parts 31 to 34 are connected to one another by respective annular clamping elements 35, 36, 37 and 38 which are of well known construction that needs no elaboration here. The annular sealing elements 20, 21, 28 and 29 are arranged at the parting planes between the various parts 31 to 34 of the frame 2 so that, besides acting as the valve seats for the respective valve balls 14, 15, 26 and 27, they also seal the interfaces between the parts 31 to 34 of the frame 2, by being confined and hence held in position between the parts 31 to 34 by the action of the respective clamping elements 35 to 38.

The lateral portions 31 and 32 of the frame 2 have respective extensions or flanges 39 and 40. The pumping arrangements 3 and 4 include casings or shells 41 and 42 which are secured, in a conventional manner which is not specifically shown in the drawing, such as by screws or similar connectors, to the control arrangement 5, and which are respectively connected, by means of annular clamping elements 43 and 44, to the flanges 39 and 40 of the lateral portions 31 and 32 of the frame 2. Hence, the shells 41 and 42 define with the associated lateral portions 31 and 32 respective internal spaces. Each of these internal spaces is subdivided by a respective movable wall 45 and 46 into the aforementioned pumping chamber 31 or 32, and an actuating chamber 47 or 48. The respective movable wall 45 or 46 includes a respective flexible diaphragm 49 or 50 which is sealingly clamped at its outer periphery between the flange 39 or 40 and the shell 41 or 42 by the action of the respective clamping element 43 or 44. At its central region, each of the diaphragms 49 or 50 is sealingly secured to a common shaft 51 that passes through the interior of the control arrangement 5 and interconnects the two movable walls 45 and 46 for movement in unison. To mount the respective diaphragms 49 and 50 on the common shaft 51, there are provided two mounting plates 52 and 53, or 54 and 55, on the common shaft 51, which confine the central region of the respective diaphragm 49 or 50 between themselves. The mounting plates 52 and 53, or 54 and 55, are mounted on the common shaft 51 by being confined between a respective shoulder 56 or 58, and a threaded fastener 57 or 59, such as a nut. Thus, the mounting plates 52 and 53, or 54 and 55, clamp the central region of the respective diaphragm 49 or 50 between themselves to mount the diaphragms 49 and 50 to the common shaft 51.

Having so described the construction of the apparatus depicted in FIG. 1, its operation will now be briefly discussed, leaving out for the time being the details of construction and operation of the control arrangement 5. It is sufficient to state at this juncture that the control arrangement 5 controls the admission of an actuating medium, especially a gaseous medium such as compressed air, into the actuating compartments or chambers 47 and 48, and the discharge of such an actuating medium from the actuating chambers 47 and 48.

In the position shown in FIG. 1, the movable walls 45 and 46 are approaching the end of their rightward stroke. This is achieved by admitting the pressurized actuating medium into the actuating chamber 48 of the pumping arrangement 4, while simultaneously allowing the contents of the actuating chamber 47 of the pumping arrangement 3 to escape from the actuating chamber 47 at a rather low superatmospheric pressure. Because of the pressure exerted by the pressurized actuating medium on the movable wall 46, and the relatively low resistance offered by the pressure of the medium contained in the actuating chamber 47 on the movable wall 45, the shaft 51 and the movable walls 45 and 46 mounted thereon are caused to move in the rightward direction. This causes a reduction in the pressure in the pumping chamber 18, so that the valve ball 14 is lifted off its valve seat element 20 and the medium to be pumped is drawn into the pumping chamber 18. Because of the reduced pressure in the pumping chamber 18, the valve ball 26 stays in its sealing contact with its associated annular valve seat element 28, so that no medium being pumped will be drawn into the pumping chamber 18 from the outlet passage 10 or the outlet port 7. At the same time, the pressure in the pumping compartment 19 is increased, which means that the valve ball 15 will remain in, or get into, sealing contact with its associated annular valve seat element 21, thus preventing the now pressurized contents of the pumping chamber 19 from escaping back into the inlet passage 9. On the other hand, the increased pressure of the medium contained in the pumping chamber 19 will cause the valve ball 27 to lift off from its associated valve seat element 29, so that the medium being pumped will be expelled from the pumping chamber 19 through the compartment 23 into the outlet passage 11 and ultimately into the outlet port 7. It will be appreciated that, once the movable walls 45 and 46 have reached the end of their rightward travel, the situation is reversed, that is, the pressurized actuating medium is admitted into the actuating chamber 47, and the contents of the actuating chamber 48 is permitted to escape from the latter, due to the action of the control arrangement 5. This will cause movement of the movable walls 45 and 46 in unison in the leftward direction, with an attendant pressure reduction in the pumping chamber 19 and increase in the pressure in the pumping chamber 18, so that the valve balls 14, 15, 26 and 27 will now move into their respective other positions in which they prevent the medium being pumped from escaping back from the pumping chamber 18 toward the inlet port 6, cause the medium being pumped to flow from the inlet port 6 into the pumping chamber 19, prevent flow of the medium being pumped back from the outlet port 7 into the pumping chamber 19 and permit the pressurized medium being pumped to flow from the pumping chamber 18 toward the outlet port 7. Another reversal takes place at the end of the leftward travel of the movable walls 45 and 46, so that the initially described operating conditions are re-established.

As mentioned before, the control arrangement 5 controls the flow of the actuating medium in and out of the actuating chambers 47 and 48. The construction of the control arrangement 5 will now be particularly described in connection with FIG. 2 of the drawing, and its operation will then be described particularly in connection with FIG. 3 of the drawing.

Figure 2:
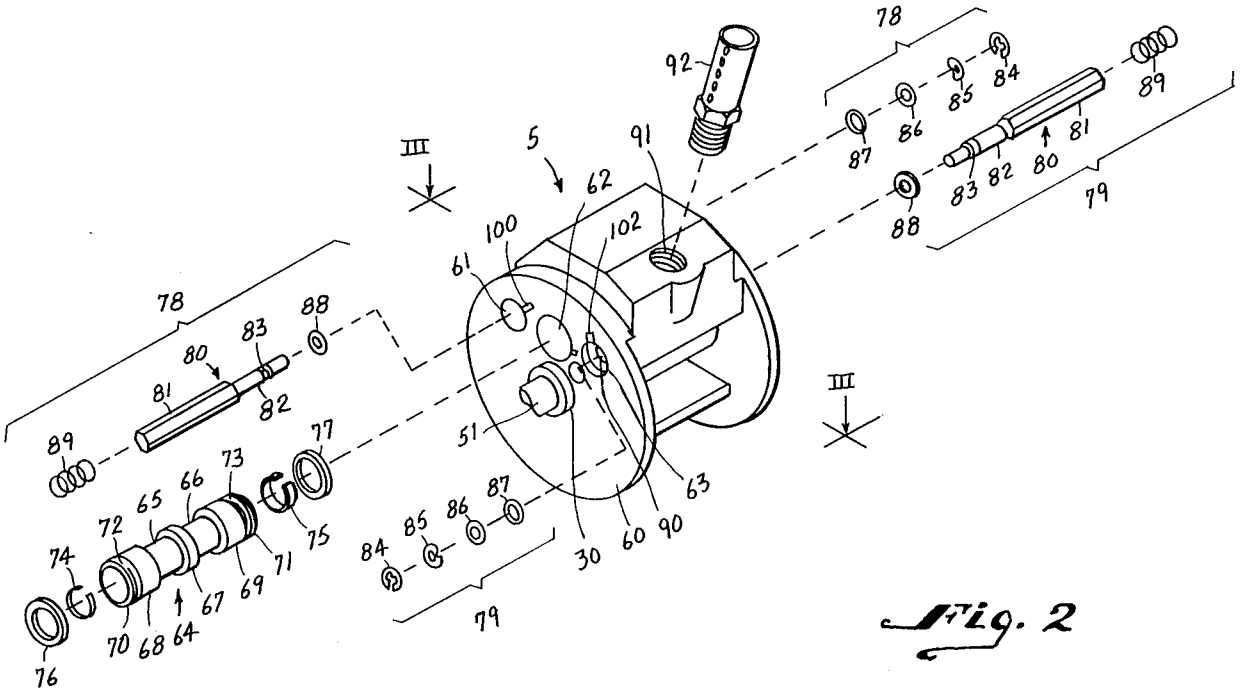
FIG. 2 is an exploded view of the control arrangement of FIG. 1.

FIG. 2 is an exploded view of the control arrangement 5 showing the various components constituting the same. One of the main components of the control arrangement 5 is a housing 60 through which the common shaft 51 passes, as shown, substantially centrally, being supported in a self-lubricated sliding bearing or bearings 30. The housing 60 has three bores 61, 62 and 63 which are indicated to extend substantially parallel at the axis of the common shaft 51, and at a radial spacing therefrom. However, it will be appreciated that the bore 62 could extend transversely of the housing 60 if so desired, for instance, in order to reduce the overall dimensions and the weight of the housing 60.

The bore 62 serves for receiving a distributing valve body 64 which is constructed as a spool valve. The distributing valve body 64 is provided with two distributing channels 65 and 66 separated from one another by a separating collar 67 and delimited at their other axial ends by respective delimiting collars 68 and 69. The distributing valve body 64 further includes, at its respective axial ends, terminal collars 70 and 71 which bound respective grooves 72 and 73 between themselves and the respective delimiting collars 68 and 69. Resilient expansion rings 74 and 75 are received in the respective grooves 72 and 73 in the assembled condition of the valve body 64, these expansion rings 74 and 75 being surrounded by respective split separating rings 76 and 77 which are also received in the respective grooves 72 and 73 at least when the distributing valve body 64 is accommodated in the bore 62.

The bores 61 and 63 accommodate respective switching or limiting valve assemblies 78 and 79 which are structurally identical so that the various components thereof will be identified by the same reference numerals in the following description and the drawing. The respective switching valve assembly 78 or 79 includes, as one of its main components, a switching valve member 80 which includes a guiding portion 81 and a stem portion 82 at one end of the guiding portion 81. The guiding portion 81 is shown to be hexagonal in cross-section. The reason for this cross-sectional configuration will be given later. The stem portion 82 is provided with a groove 83 that serves to partially accommodate an abutment washer 84. Next to the abutment washer 84, there are arranged, around the part of the stem portion 82 which extends between the groove 83 and the guiding portion 81, in succession, a spring washer 85, a separating washer 86, a sealing ring 87, and an additional sealing ring 88. Furthermore, a helical compression spring 89 is accommodated in the respective bore 61 or 63 at the opposite axial end of the guiding portion 81 from the stem portion 82. FIG. 2 also indicates that an annular element 90 is arranged at one axial end of the bore 63. Similarly, another such annular element 90 is arranged in the bore 61, but at the opposite axial end thereof. It is also shown in FIG. 2 that the housing 60 has an internally threaded discharge bore 91, and that a discharge nipple or connector 92 having an externally threaded end portion is threaded into the bore 91 in its assembled condition. The housing 60 also has a feeding nipple or connector similar to the discharge nipple or connector 92, but not visible in FIG. 2 since it is obscured by the housing 60.

Figure 3:
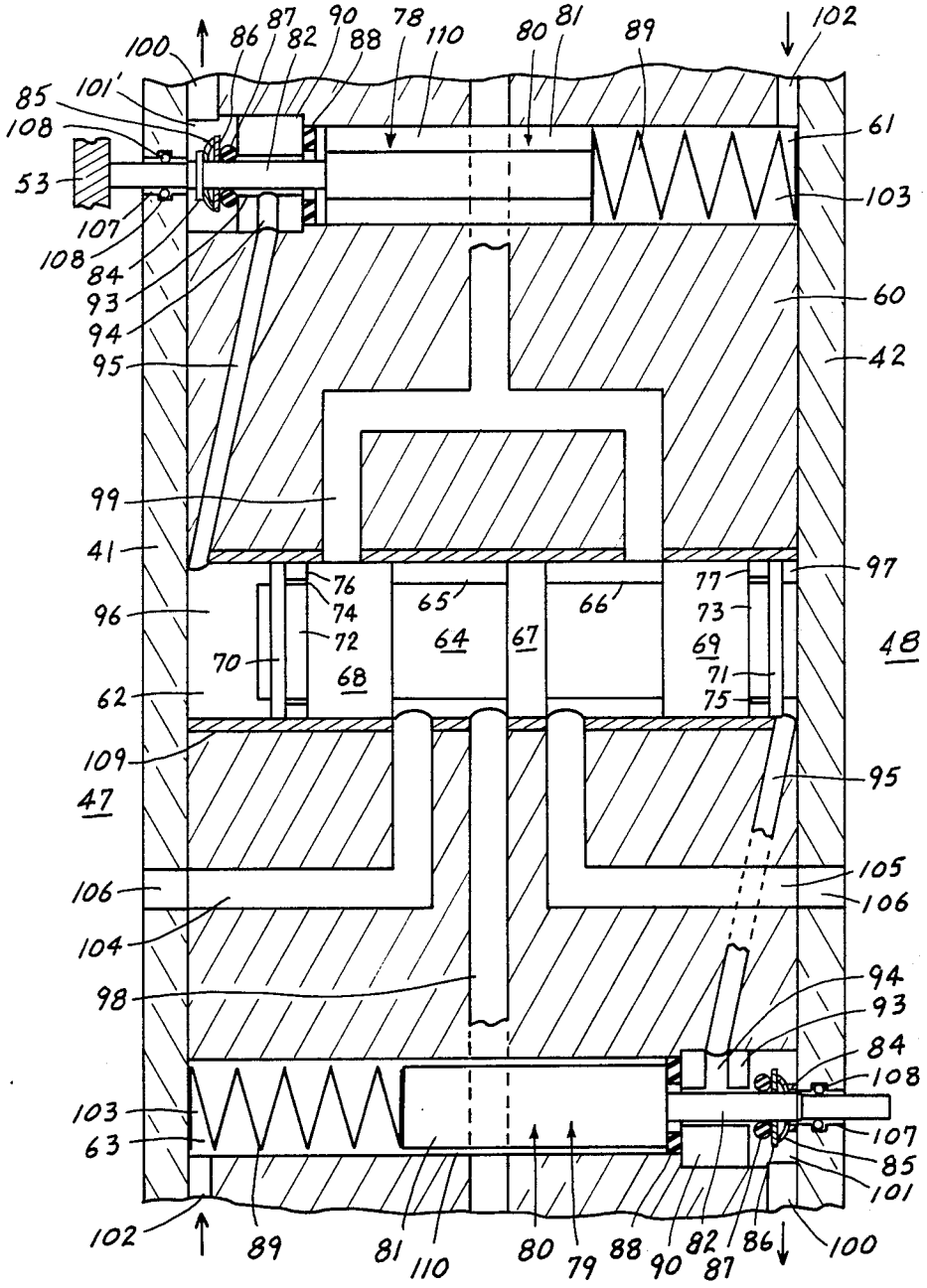
FIG. 3 is a developed, somewhat diagrammatic, view of the arrangement of FIG. 2 taken basically along the plane indicated by the reference numerals III—III in FIG. 2.

The distributing valve body 64, and the limiting valve assemblies 78 and 79 are shown in FIG. 3 in the assembled conditions and as accommodated in the respective bores 62, 61 and 63. It may be seen that the sealing elements or rings 86 and 88 are arranged at the opposite axial sides of the annular element 90. It may also be seen that, because of its hexagonal cross-section, the guiding portion 81 is in contact with, and thus is guided by, the surface bounding the bore 61 or 63, as shown in connection with the limiting valve assembly 78. Yet, as shown in connection with the switching or limiting valve assembly 79, gaps 110 exist between the regions of contact of the guiding portion 81 with the surface bounding the respective bore 61 or 63, these gaps 110 providing for communication between the spaces accommodating the helical springs 89 and those accommodating the sealing element 88 in the respective bores 61 or 63. While the guiding portion 81 has been shown to have a hexagonal cross-section, it will be appreciated that the same combination of guiding and bypass functions could also be achieved by giving the bores 61 and 63 and the guiding portions 81 other non-complementary cross-sections with multiple contact areas therebetween.

FIG. 3 also illustrates that each of the annular elements 90 has a central passage 93 through which the stem portion 82 of the respective limiting valve body 80 passes with clearance, and a substantially radially extending passage 94 which communicates the central passage 93 with a respective passage 95 provided in the housing 60 and opening into an actuating space 96 or 97 which is delimited in the bore 62 by the respective shell 41 or 42 and the respective terminal collar 70 or 71 that is close to it. The housing 60 also has a feeding duct 98 which is connected to the aforementioned feeding connector and opens into the bore 62 substantially centrally thereof, and a branched or bifurcated discharge duct 99 which opens into the bore 62 at locations at least axially spaced by a predetermined distance from and at opposite axial sides of the feeding duct 98. The discharge duct 99 leads to the discharge nipple 92 mentioned above.

The housing 60 further has two discharge channels 100 each of which communicates, at one of its ends, with a space 101 of the respective bore 61 or 63 next to the respective annular element 90 and, at its other end, in a manner which is not shown in the drawing, with the discharge nipple 92. Furthermore, the housing 60 has two feeding channels 102 each of which communicates, at its one end, with a space 103 of the respective bore 61 or 63 that accommodates the helical spring 89 and, at its other end, in a manner which is also not illustrated, with the aforementioned feeding nipple or connector. The channels 100 and 102 are covered, in a sealing manner, by the respective shells 41 and 42. Finally, the housing 60 also has supply and relief ducts 104 and 105 which open into the bore 62 at locations situated axially spaced from and between the locations at which the feeding duct 98 and the discharge duct 99 open into the bore 62.

The respective shells 41 and 42 are provided with orifices 106 through which the supply and relief ducts 104 and 105 are in communication with the respective chambers 47 and 48 of the pumping units 3 and 4. The shells 41 and 42 further have openings 107 through which the stem portions 82 of the respective valve members 80 pass into the respective chambers 47 and 48, being sealed in the openings 107 by respective self-lubricating seals 108 of a conventional construction.

The housing 60 is advantageously made of aluminum and is provided, at least all over the surface bounding the bore 62, with a hard anodized coating layer 109. The valve member or spool 64 is made, either in its entirety, or at least at its portion that comes into contact with the layer 109, of a material that needs no lubrication or is self-lubricating. Many such self-lubricating materials are known, but particularly good results were obtained with the spool 64 being made of polytetrafluoroethylene mixed with a mica filler. However, since this material has a tendency to swell under certain operating conditions, it was attempted to make the spool 64 with a core of a metallic material and with a cladding layer of the polytetrafluoroethylene. The results of this attempt were even better than those obtained before, especially when the core was made of aluminum. Experience has shown that these two materials, that is, the mica-filled polytetrafluoroethylene of the spool 64 and the hard anodized aluminum of the coating layer 109 of the housing 60 cooperate with one another very well and that it is not necessary to lubricate the valve body 64 by oil or another lubricant to achieve free sliding of the spool 64 in the bore 62 solely in response to pressure differentials acting in the axial directions of the spool 64. It appears that during the operation, some of the mixture rubs off onto the coating layer 109, further improving the sliding conditions.

Having so described the construction of the pump 1 inclusive of the control arrangement 5 thereof, the operation of the control arrangement 5 will now be described with reference to FIG. 3 of the drawing.

The positions of the various components of the control arrangement 2 as illustrated in FIG. 3 are those which such components assume at the time of reversal from movement of the shaft 51 (see FIG. 1) in the rightward direction to the movement in the leftward direction, and more particularly at the beginning of the leftward movement. At this time, the valve member 80 of the limiting valve 79 is in its rightmost position, being maintained therein by the action of the spring 89 and the difference between the pressures acting on the valve member 80 in the opposite axial directions. This means that the seal 88 is in a sealing contact with both the annular element 90 and the guiding portion 81 of the limiting valve assembly 79, so that it interrupts communication between the gaps 110 and the central passage 93. At the same time, the sealing element 87 is spaced from the annular element 90, which means that an uninterrupted path is established between the chamber 97 through the duct 95, the radial passage 94, the central passage 93, the space 101 and the channel 100, ultimately with the discharge nipple 92. Hence, the pressure then prevailing in the chamber 97 will be substantially equal to the ambient pressure, while the pressure in the space 103 is superatmospheric, resulting in the aforementioned pressure difference.

FIG. 3 also shows that the mounting element 53, of which only a fragment is shown, has previously, during its rightward movement, contacted the stem portion 82 of the valve member 80 of the limiting valve assembly 78 and depressed it, so that the entire limiting valve assembly 78 has been shifted in the rightward direction from its position into which it is urged by the spring 89. This movement in the rightward direction eventually resulted in the illustrated situation where the sealing element 87, aided by the resilient action of the spring washer 85, seals the interfaces between the annular element 90, the stem portion 82 and the annular washer 86, thereby interrupting the communication between the passage 93 and the space 101, the channel 100 and ultimately the discharge nipple 92. However, this rightward movement of the valve member 80 of the limiting valve assembly 78 also results in a termination of the sealing action of the sealing element 88, so that an uninterrupted path is created from the aforementioned feeding nipple through the channel 102, the space 103, the gaps 110 past the guiding portion 81, the central passage 93, the radial passage 94, the duct 95 to the space 96. In this manner, the superatmospheric pressure supplied to the feeding nipple is able to propagate into the space 96 to act on the end face of the spool 64, thus shifting it into the illustrated rightward position thereof against nonexistent or negligible superatmospheric pressure in the space 97.

Once this shift occurs, the previously existing communication between the chamber 47 through the orifice 106, the duct 104, the channel 65 with the left-hand branch of the discharge duct 99 and thus with the discharge nipple 92 is discontinued and instead communication is established between the chamber 47 through the orifice 106, the duct 104, the channel 65 with the feeding duct 98 and ultimately with the feeding nipple so that the superatmospheric pressure from the feeding nipple propagates into the chamber 47. Thus, this superatmospheric pressure will now act on the movable wall 45 to urge the same in the leftward direction. The above-mentioned rightward shift of the spool 64 has also interrupted the previously existing communication between the chamber 48 through the orifice 106, the duct 105, the channel 66 and the duct 98 ultimately with the feeding nipple. On the other hand, the rightward shift of the spool 64 has established communication between the chamber 48 through the orifice 106, the duct 105, the channel 66 and the right-hand branch of the duct 99 ultimately with the discharge nipple 92. This, of course, means that the pressure in the actuating chamber 48 is relieved, for all intents and purposes, to the level of the ambient pressure so that it does not counteract the action of the superatmospheric pressure now prevailing in the actuating chamber 47 on the movable wall 45. Hence, the shaft 51 and the movable walls 45 and 46 mounted thereon will commence their movement in the leftward direction, with attendant pumping action on the medium contained in the pumping chambers 18 and 19 as described above in connection with FIG. 1. This leftward movement, which also involves the leftward movement of the mounting element 53, will be accompanied by concurrent leftward movement of the valve member 80 of the limiting valve assembly 78 under the action of the associated helical spring 89, until communication of the space 96 with the channel 102 is interrupted and that with the channel 100 is established, whereby the pressure in the space 96 is relieved. However, the spool 64 will remain in its then assumed position since the pressure in the space 97 is substantially the same as that in the space 96 or, at least initially, lower. The spool 64 remains in this position until the mounting element 55 of the movable wall 56 contacts the stem portion 82 of the valve member 80 of the limiting valve assembly 79 and depresses the same to the extent necessary to interrupt the communication of the space 97 with the channel 100 and establish communication of the chamber 97 with the channel 102.

As mentioned before, it is not necessary to lubricate the spool 64 since it is made at least at its periphery of a synthetic plastic material which needs no lubrication. Moreover, instead of using elastic sealing rings on the spool 64, as customary in the valve manufacturing field, the arrangement of the present invention uses the separating rings 76 and 77 which are made of a relatively rigid synthetic plastic material which is also of the self-lubricating type. A material particularly well suited for this purpose is polytetrafluoroethylene filled with graphite. Hence, as these separating rings 76 and 77 slide along the inner surface of the coating layer 109, they will gradually wear off to a slight extent, which will deposit a layer of polytetrafluoroethylene and/or graphite on the internal surface of the coating layer 109. This deposited layer including the ingredients which have become dissociated from the spool 64 and/or the separating rings 76 and 77 will act as a lubricant and eliminate or at least slow down the further wear of the separating rings 76 and 77. Moreover, the deposited material will fill any crevices or depressions in the hard anodized coating layer 109, thus presenting a highly smooth sliding surface to the spool 64 and the separating rings 76 and 77.

The back-up resilient expansion rings 74 and 75 urge the separating rings 76 and 77, respectively, in the radially outward direction into sliding contact with the internal surface of the coating layer 109. This introduces a certain amount of drag or hesitation into the movement of the spool 64 so that, even if the spool 64 is subject to vibrations, such as may occur during the operation of the pump, it will not accidentally shift out of its respective end position toward the other end position.

The separating rings 76 and 77, as shown in FIG. 2, are split to be able to radially outwardly expand in response to the urging of the resilient expansion rings 74 and 75. This split, of course, introduces a discontinuity into the separating ring 76 or 77, through which fluid could flow between the channel 65 and the space 96 or the channel 66 and the space 97. However, experience has shown that such leakages are negligible and do not adversely effect the operation of the control arrangement 5. Additional amounts of the compressed gaseous medium could flow past the separating rings 76 and 77 at the interfaces thereof with the delimiting collars 68 or 69 and the terminal collars 70 and 71. However, even this leakage is negligible particularly since, as soon as the spool 64 starts its movement out of its one end position towards it other end position, the drag acting on the respective separating rings 76 or 77 will cause the same to sealingly contact one of the collars 68 or 70, or 71 and 69, depending on the direction of movement of the spool 64. This sealing contact will be preserved until the spool 64 starts moving in the opposite direction.

In any event, the presence and sealing effect of the separating rings 76 and 77 prevent more serious leakages of the pressurized air through the interfaces between the spool 64 and the coating layer 109, which would otherwise result in undesired pressure buildups or reductions, with attendant reduction in or loss of operating reliability.

The guiding portions 81 of the valve members 80 are preferably of such a material and have such a shape as also to need no lubrication. This means that the limiting valve assemblies 78 and 79 will not have to be lubricated either, so that the pressurized air which is used to operate the control arrangement 5 need not have to have any oil droplets entrained therein. This is a pronounced advantage as compared to conventional valve or pump arrangements, in that any dust or other contaminants which may be present in the pressurized air will not be caused to adhere to the various components of the control arrangement 5 by the action of the entrained oil or similar lubricant. The hexagonal cross-section of the guiding portions 81, with the attendant limited contact between the respective guiding portion 81 and the surface bounding the bore 61 or 63, is particularly useful in eliminating the need for lubrication.

The outlet nipple connector 92 is shown to be constructed as a silencer, so that it can be used in an ambient environment with discharge of the spent air into the ambient atmosphere. However, for use of the pump 1 in submersed applications, that is, where the pump is immersed in liquid at least to the level of the discharge nipple or connector 92, it is possible to connect a hose or a similar conduit to the connector 92 and to have such a hose lead to the exterior of the liquid medium in which the pump 1 is submersed.

While I have described above the principles of my invention in connection with specific apparatus, it is to be clearly understood that this description is made only by way of example and not as a limitation to the scope of my invention as set forth in the objects thereof and in the accompanying claims.

I claim:

1. A limiting valve assembly for use with a reciprocating member and a pressurized medium user, comprising:

a housing having a bore which opens toward the movable member;

a limiting valve assembly accommodated in said bore and including a valve member guided in said bore for movement in opposite axial directions between two end positions and having a stem portion projecting from said bore into the path of movement of the movable member to be moved by the latter from one of said end positions toward the other, axially spaced first and second confining portions at the region of said stem portion, and a spring urging said valve member toward said one end position;

means for supplying a pressurized gaseous medium to a first region of said bore;

means for discharging gaseous medium from a second region of said bore that is axially spaced from said first region;

means for communicating a third region of said bore that is situated between said first and second regions with the user; and means in said bore for sealingly separating said communicating means from said supplying means in said one end position, and from said discharging means in said other end position, of said valve member, including an annular element stationarily mounted in the respective bore at said third region and situated between said confining portions of the respective valve member, said annular element having a central passage through which said stem portion passes with clearance and a substantially radial passage that connects said central passage with said communicating means, each of said two sealing elements being arranged around said stem portion at a different axial side of said annular element and between the latter and the respective confining portion to be confined therebetween and sealingly interrupt communication of said communicating means with said supplying means in said one, and with said discharging means in said other of said end positions of said valve member, and to become spaced therefrom and allow communication of said communicating means with said discharging means in said one, and with said supplying means in said other, of said end positions of said valve member to thereby alternately admit the pressurized gaseous medium to and discharge the gaseous medium from the user.

2. A diaphragm pump for pumping liquids, especially such having a high viscosity, comprising:

two diaphragm pump arrangements arranged along a common axis in opposing relationship to one another and each including a casing having inlet and outlet ports for the liquid to be pumped, and a movable wall sealingly subdividing the interior of the casing into a pumping chamber and an actuating chamber;

a shaft extending in parallelism with said axis and interconnecting said movable walls of said diaphragm pump arrangement for movement in unison; and means for operating said pump arrangements to alternatingly draw the liquid into and expel the same out of the respective pumping chambers through the respective inlet and outlet ports including a control housing interposed between and secured to said casings and having three bores therethrough at least two of which extend substantially parallel to said axis, two limiting valve assemblies each accommodated in one of said two bores and including a valve member guided in the respective bore for movement in opposite axial directions between two end positions and having a stem portion projecting into a different one of said actuating chambers for each of said valve members and into the path of movement of the respective movable wall to be moved by the latter from one of said end positions toward the other, axially spaced first and second confining portions at the region of said stem portion, and a spring urging said valve member toward said one end position, a spool valve accommodated in the remaining one of said three bores for movement axially thereof between two terminal positions and having a circumferential surface having two distributing grooves and two end faces that delimit in said remaining bore respective end spaces, means for supplying a pressurized gaseous medium into said bores and to a first region of each of said two bores, means for discharging gaseous medium from said bores and from a second region of each of said two bores that is axially spaced from said first region, means for communicating a third region of each of said two bores that is situated between said first and second regions with a different one of said end spaces of said remaining bore, means for separately establishing communication between said remaining bore and each of said actuating chambers, and means in each of said two bores for sealingly separating said communicating means from said supplying means in said one end position, and from said discharging means in said other end position, of the respective valve member, said sealingly separating means including an annular element stationarily mounted in the respective bore at said third region and situated between said confining portions of the respective valve member, said annular element having a central passage through which the respective stem portion passes with clearance and a substantially radial passage that connects said central passage with said communicating means, said two sealing elements each being arranged around said stem portion at a different axial side of said annular element and between the latter and the respective confining portion to be confined therebetween and sealingly interrupt communication of said communicating means with said supplying means in said one, and with said discharging means in said other of said end positions of said valve member, and to become spaced therefrom and allow communication of said communicating means with said discharging means in said one, and with said supplying means in said other, of said end positions of said valve member to thereby admit the pressurized gaseous medium into one and discharge the gaseous medium from the respective other of said end spaces with attendant movement of said spool valve from one to the other of said terminal positions thereof in which communication is established via the respective distributing channels between said supplying means and one of said actuating chambers, and the respective other of said actuating chambers and said discharging means.

3. The diaphragm pump as defined in claim 2, wherein said spool member is, at least at its portion contacting the surface bounding said remaining bore, of a material requiring no external lubrication.

4. The diaphragm pump as defined in claim 3, wherein said material is a synthetic plastic material.

5. The diaphragm pump as defined in claim 4, wherein said synthetic plastic material is polytetrafluoroethylene filled with mica.

6. The diaphragm pump as defined in claim 2, wherein said spool valve has external grooves at respective end portions thereof, which open onto said circumferential surface; and further comprising separating rings accommodated in said grooves and contacting the surface bounding said remaining bore.

7. The diaphragm pump as defined in claim 6, and further comprising resilient expansion rings received in said grooves of said spool valve internally of said separating rings and urging the latter radially outwardly into contact with the surface bounding said remaining bore.

8. The diaphragm pump as defined in claim 6, wherein said separating rings are of a material requiring no external lubrication.

9. The diaphragm pump as defined in claim 8, wherein said material is a synthetic plastic material.

10. The diaphragm pump as defined in claim 9, wherein said synthetic plastic material is polytetrafluoroethylene filled with graphite.

11. The diaphragm pump as defined in claim 2, wherein at least the surface bounding said remaining bore is constituted by a hardened layer.

12. The diaphragm pump as defined in claim 11, wherein said housing is of aluminum; and wherein said hardened layer is an anodized layer of the aluminum of said housing.

* * * * *